US006104138A

United States Patent [19]

Martelli et al.

[11] Patent Number: 6,104,138

[45] Date of Patent: Aug. 15, 2000

[54] FRITTABLE-EVAPORABLE GETTERS HAVING DISCONTINUOUS METALLIC MEMBERS, RADIAL RECESSES AND INDENTATIONS

[75] Inventors: Daniele Martelli, Milan; Luisa Mantovani, Lainate; Stefano Trivellato, Gerenzano; Giuseppe Urso, Seregno; Raffaello Lattuada, Cerro Maggiore, all of Italy

[73] Assignee: Saes Getters S.p.A., Lainate, Italy

[21] Appl. No.: 09/004,625

[22] Filed: Jan. 8, 1998

[30] Foreign Application Priority Data

Jan. 10, 1997 [IT] Italy ..... MI97A0036
Jan. 10, 1997 [IT] Italy ..... MI97A0037

[51] Int. Cl.[7] ..... H01K 1/52; H01J 17/22; H01J 19/70; H01J 61/24; H01J 17/24

[52] U.S. Cl. ..... 313/546; 313/549; 313/553; 313/560; 313/561

[58] Field of Search ..... 313/545–46, 547, 313/549, 550–51, 553, 554–55, 560–61, 562, 563, 567, 564, 548

[56] References Cited

U.S. PATENT DOCUMENTS

| | | |
|---|---|---|
| 3,428,168 | 2/1969 | Reash . |
| 3,558,962 | 1/1971 | Reash . |
| 3,560,788 | 2/1971 | Reash . |
| 3,737,709 | 6/1973 | Hornman et al. . |
| 4,127,361 | 11/1978 | Hellier et al. . |
| 4,128,782 | 12/1978 | Fransen et al. . |
| 4,323,818 | 4/1982 | Madden et al. . |
| 4,342,662 | 8/1982 | Kimura et al. . |
| 4,486,686 | 12/1984 | della Porta . |
| 4,504,765 | 3/1985 | della Porta . |
| 4,642,516 | 2/1987 | Ward et al. . |
| 4,717,500 | 1/1988 | Fisch et al. . |
| 4,961,040 | 10/1990 | della Porta et al. . |
| 5,118,988 | 6/1992 | della Porta . |
| 5,508,586 | 4/1996 | Martelli et al. . |

FOREIGN PATENT DOCUMENTS

| | | |
|---|---|---|
| 0 036 681 A1 | 9/1981 | European Pat. Off. . |
| 59-117038 | of 0000 | Japan . |
| 51-36037 | 10/1976 | Japan . |
| 2-6185 | 2/1990 | Japan . |
| 3-78928 | 4/1991 | Japan . |
| WO 89/10627 | 11/1989 | WIPO . |
| WO 91/06113 | 5/1991 | WIPO . |

*Primary Examiner*—Michael H. Day
*Assistant Examiner*—Mack Haynes
*Attorney, Agent, or Firm*—Hickman Stephens Coleman and Hughes, LLP

[57] ABSTRACT

A frittable evaporable getter device includes a metallic container having a disk-shaped bottom wall and a side wall extending upwardly from the bottom wall. A powder compact having an upper surface in which at least two radial recesses are formed is disposed in the container. The powder compact is formed of a mixture of $BaAl_4$ powder and nickel powder. A discontinuous metallic member is embedded in the powder compact such that the member does not protrude from the upper surface of the powder compact and the member is spaced apart from the bottom wall of the container. An evaporable getter device having reduced activation time includes a powder compact formed of a mixture of $BaAl_4$ powder, nickel powder, and between about 0.3% and about 5% by weight based on the total weight of the mixture of a third component selected from aluminum, iron, titanium, and alloys thereof.

19 Claims, 5 Drawing Sheets

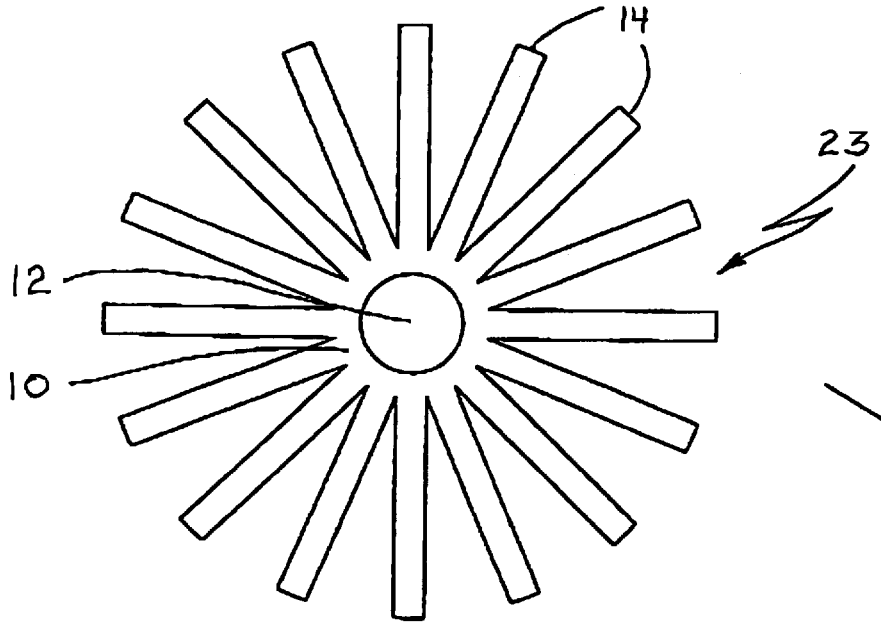
Fig. 1
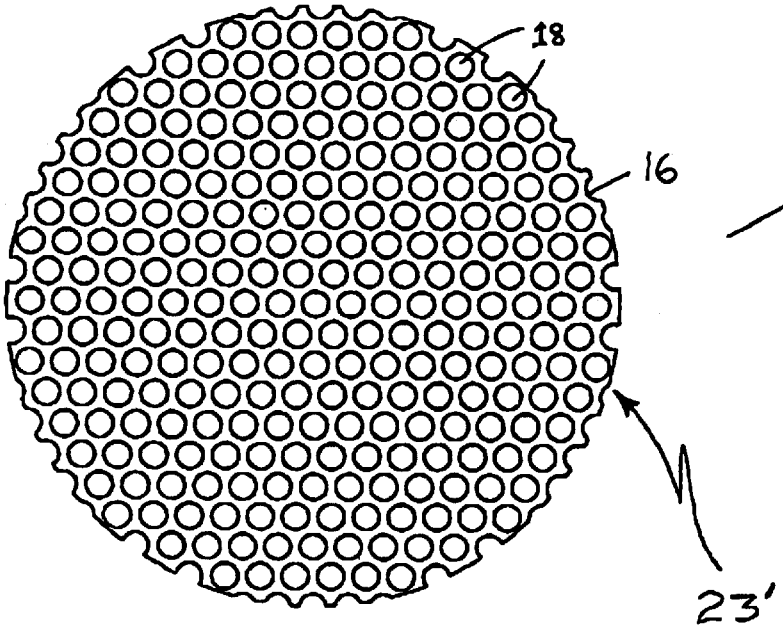

FRITTABLE-EVAPORABLE GETTERS HAVING DISCONTINUOUS METALLIC MEMBERS, RADIAL RECESSES AND INDENTATIONS

CLAIM FOR PRIORITY

This patent application claims priority under 35 U.S.C. § 119 from Italian Patent Application Serial No. MI97A 000036, filed Jan. 10, 1997, and Italian Patent Application Serial No. MI97A 000037, filed Jan. 10, 1997, both of which are incorporated herein by reference for all purposes.

BACKGROUND OF THE INVENTION

The present invention relates generally to getter devices and, more particularly, to frittable evaporable getter devices with a high yield of barium, frittable evaporable getter devices with a high yield of barium and reduced activation time, evaporable getter devices with reduced activation time, and an evaporable getter material. Evaporable getter materials are used to maintain a vacuum within the interior of picture tubes for television sets and computer screens. The use of evaporable getter materials within the interior of flat panel displays is also being studied in connection with the development of such displays.

The getter material commonly used in picture tubes is metallic barium. This material is deposited in the form of a thin film on an inner wall of the tube. To form the thin film, an evaporable getter device is introduced in the tube during the manufacturing process. The evaporable getter device typically includes an open metallic container in which a powder compact containing powder of a compound of barium and aluminum, $BaAl_4$, and powder of nickel, Ni, in a weight ratio of about 1:1 is disposed. In an activation process referred to as "flashing," the device is induction heated by means of a coil situated outside the tube. When the temperature of the powder compact reaches approximately 800° C., the following reaction takes place:

$$BaAl_4+4Ni \rightarrow Ba+4NiAl \quad \text{(I).}$$

This reaction is highly exothermic and raises the temperature of the powder compact to about 1,200° C., at which temperature barium evaporation occurs. Barium vapors then sublimate onto the walls of the tube to form the metallic thin film.

Evaporable getter devices are well known in the art. For example, U.S. Pat. No. 5,118,988 to della Porta, which is assigned to SAES Getters, S.p.A., discloses an evaporable getter device in which a number of radial recesses are formed in the free surface of the powder compact to retard heat propagation through the powder compact in a circumferential direction and thereby obtain a controlled barium flash. U.S. Pat. No. 3,558,962 to Reash discloses an evaporable getter device in which a metallic element, e.g., a metallic screen, is at least partially buried in the powder compact to conduct heat to the center thereof and thereby obtain uniform flashing of barium.

The manufacturing processes for both traditional picture tubes and flat panel displays involve the joining of two glass plates in a so-called "frit sealing" operation. In this operation a glass paste having a melting temperature of about 450° C. is melted or softened between the two glass plates in the presence of air. After the frit sealing operation, a getter device may be introduced in traditional picture tubes through the neck provided for housing the electronic gun. In this case, however, the size of the getter device is limited by the neck diameter and precise positioning of the device within the picture tube is difficult. On the other hand, in the case of flat panel displays, it is practically impossible to position the getter device after the frit sealing operation. Consequently, picture tube manufacturers tend to insert the getter device before the frit sealing operation. One drawback with this practice is that the getter device is exposed, at a temperature of about 450° C., to atmospheric gases and the vapors released by the low-melting temperature glass paste during the frit sealing operation. The primary result of such exposure is the oxidation of nickel on the surface of the powder compact. During barium flashing, the thus-formed nickel oxide and aluminum undergo a highly exothermic reaction which cannot be controlled. This may lead to a portion of the powder compact being raised from the bottom of the container, the ejection of fragments of the powder compact from the container, or the partial melting of the container. These problems are detrimental to the proper operation of both the getter device and also the tube as a whole. A more controlled barium evaporation could theoretically be obtained by supplying the device with less power during the flashing operation. This solution would not be acceptable in the picture tube industry, however, because it would increase the evaporation time.

Evaporable getter devices which can withstand frit sealing conditions, i.e., exposure to an oxidizing atmosphere at 450° C. for up to two hours, without suffering from the above-described drawbacks are referred to as being "frittable." Frittable evaporable getter devices are commercially available from SAES Getters S.p.A. of Milan, Italy, the assignee of the subject application. Such devices can be manufactured using conventional technologies provided certain parameters are not exceeded. In particular, the thickness of the powder compact cannot exceed a certain maximum thickness because, at greater thicknesses, the heat generated in the powder compact dissipates slowly, which gives rise to the above-described problems. It has been found empirically that the ratio between the quantity of barium in the device, in mg, and the diameter of the device, in mm, should not be more than about 10. For reasons dictated by the process by which picture tubes are manufactured, the maximum diameter of frittable evaporable getter devices is about 20 mm. Consequently, the maximum quantity of barium that can be evaporated from such devices manufactured in accordance with conventional technologies is about 200 mg. Large picture tubes currently being produced require at least 300 mg of barium, however. As such, conventional frittable evaporable getter devices cannot provide the amount of evaporated barium required for such large picture tubes.

For purposes of the discussion herein, frittable evaporable getter devices capable of evaporating in excess of 200 mg of barium will be referred to as "high yield" devices. Attempts to obtain such high yield devices by resorting to prior solutions which have provided excellent results in the case of non-frittable getter devices have been unsuccessful. For example, when radial recesses are formed in the surface of the powder compact as described in U.S. Pat. No. 5,118,988, the barium evaporation process following the frit sealing operation causes swelling of the powder compact or the ejection of fragments therefrom. Devices formed in accordance with U.S. Pat. No. 3,558,962 are also non-frittable because they suffer from the problems described above, regardless of whether the metallic screen is welded to, or otherwise in contact with, the bottom of the container or is pressed into the free surface of the powder compact.

The production of frittable getter devices without dimensional limits, which are consequently high yield devices, is described in various patents. For example, U.S. Pat. No.

4,127,361 to Hellier et al., which is assigned to SAES Getters S.p.A., discloses evaporable getter devices which can be made frittable by means of a protective organosilane coating. In spite of its efficiency, the process by which this coating is formed is too slow for industrial production.

U.S. Pat. No. 4,342,662 to Kimura et al. discloses a frittable evaporable getter device in which the powder compact is coated with a glass-like film of boron oxide containing up to 7% of silicon oxide. Japanese Patent Publication No. 2-6185 discloses a frittable evaporable getter device in which nickel powder is coated with a film of boron oxide. Both of these devices are difficult to manufacture, however, because such films must have a controlled and reproducible thickness.

In addition to frittability, another important characteristic of evaporable getter devices is activation time, which refers to the time required to evaporate all the barium contained in the device. The activation time, which is also referred to as "total time" or "TT," is measured from the instant the induction heating coil is supplied with power. The TT for conventional getter devices currently being used to manufacture large picture tubes which require at least 300 mg of barium is about 40–45 seconds. This time period corresponds to the slowest step in current production lines for picture tubes. Accordingly, an evaporable getter device with a shorter TT would enable manufacturers to increase the rate at which picture tubes are produced.

A shorter TT theoretically could be obtained either by increasing the power supplied to the coil or by increasing the reactivity of the powders by using powders having smaller particle sizes. However, neither of these approaches is effective in conventional getter devices. Specifically, when the power supplied to the coil is increased, the temperature of the container increases too quickly for homogeneous diffusion of heat into the powder compact to occur, which may lead to melting of the container. When powders having smaller particle sizes are used, an excessive and local increase in the reaction rate between $BaAl_4$ and Ni occurs which may cause bulging of the powder compact and ejection of fragments of the powder compact from the container.

In view of the foregoing, there is a need for evaporable getter devices which have characteristics such as frittability, high barium yield, and reduced activation time and which do not suffer from the above-described drawbacks of conventional devices.

SUMMARY OF THE INVENTION

Broadly speaking, the invention fills this need by providing evaporable getter devices having a specifically positioned metallic member which renders such devices frittable. The invention also provides an evaporable getter material having reduced activation time which may be used in evaporable getter devices.

In one aspect of the invention, a frittable evaporable getter device is provided. This device includes a metallic container having a disk-shaped bottom wall and a side wall extending upwardly from the bottom wall. A powder compact having an upper surface in which at least two radial recesses are formed is disposed in the container. The powder compact is comprised of a mixture of $BaAl_4$ powder and nickel powder. A discontinuous metallic member is embedded in the powder compact such that the member does not protrude from the upper surface of the powder compact and the member is spaced apart from the bottom wall of the container. In this embodiment, the metallic member is preferably substantially planar and is preferably embedded in the powder compact so that it is substantially parallel to the bottom wall of the container.

In one preferred embodiment, the metallic member includes a central portion having an aperture therein and a plurality of projections extending radially from the central portion. In another preferred embodiment, the metallic member is disk-shaped and has a plurality of holes formed therein.

In another embodiment, the side wall of the metallic container has an indentation which extends inwardly toward an inner region defined by the bottom wall and the side wall of the container. The metallic member is embedded in the powder compact such that the member is at least partially supported by the indentation.

In a further embodiment, the metallic member has a substantially planar portion and at least one flange portion extending downwardly from the planar portion. In this embodiment, the metallic member is embedded in the powder compact such that the at least one flange portion contacts the bottom wall of the container.

In yet another embodiment, the bottom wall of the metallic container has at least one indentation which extends upwardly toward an inner region defined by the bottom wall and the side wall of the container. The metallic member is embedded in the powder compact such that the member rests on the at least one indentation.

The weight ratio of the $BaAl_4$ powder to the nickel powder is preferably between about 1.2:1 and about 1:1.2, and more preferably about 1:1. In a preferred embodiment, the powder compact further includes a nitrogen dispenser compound selected from the group consisting of iron nitride, germanium nitride, and intermediate nitrides of iron and germanium.

In another aspect of the invention, an evaporable getter material having reduced activation time is provided. This material is formed of a mixture of $BaAl_4$ powder, nickel powder, and between about 0.3%and about 5% by weight based on the total weight of the mixture of a third component selected from the group consisting of aluminum, iron, titanium, and alloys thereof. In the case of aluminum, the preferred amount is between about 0.8% and about 2% by weight based on the total weight of the mixture. In the case of iron, the preferred amount is between about 0.3% and about 1.2% by weight based on the total weight of the mixture. In the case of titanium, the preferred amount is between about 0.5% and about 5% by weight based on the total weight of the mixture. The particle size of the powder of the third component is preferably less than about 80 $\mu$m, and more preferably less than about 55 $\mu$m.

In a further aspect of the invention, evaporable getter devices having reduced activation time are provided. These devices include a metallic container and a powder compact formed of the evaporable getter material of the invention disposed in the container. By combining the evaporable getter material and the frittable evaporable getter device of the invention, a frittable evaporable getter device having reduced activation time may be obtained.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

FIG. 1 shows two embodiments of discontinuous, substantially planar metallic members suitable for use in the frittable evaporable getter devices of the invention.

DETAILED DESCRIPTION OF THE PREFERRED EMBODIMENTS

Figure 2:
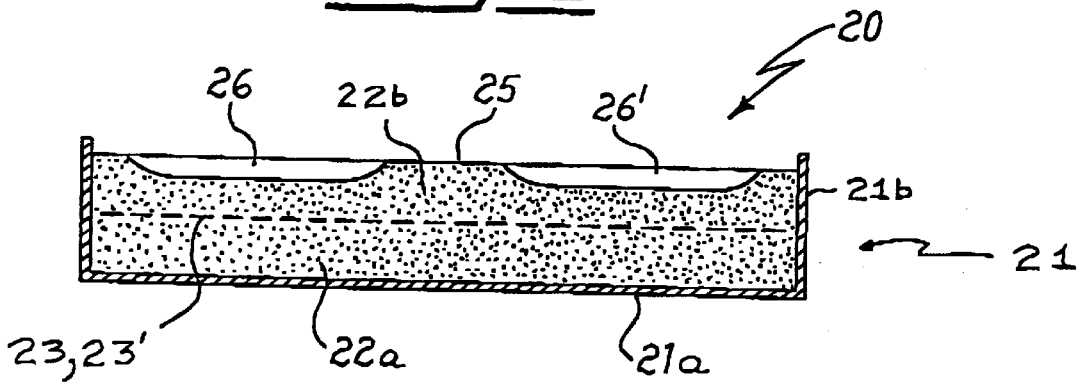
FIG. 2 shows a cross-sectional view of a frittable evaporable getter device in accordance with one embodiment of the invention.

Reference will now be made to the present preferred embodiments of the invention, examples of which are illustrated in the accompanying drawings.

In one aspect, the present invention provides evaporable getter devices having a specifically positioned metallic member which renders such devices frittable. In accordance with the invention, the metallic member is embedded in a powder compact disposed in a metallic container such that the member does not protrude from the upper surface of the powder compact and the member is spaced apart from the bottom wall of the container. When a getter device including a metallic container and a metallic member embedded in the powder compact is induction heated, the getter material powder is heated primarily by heat transferred to such powder from the container and the member. It has been observed that the transfer of heat to the getter material powder in areas of contact between the metallic member and the bottom wall of the container is highly inefficient to the point that local overheating takes place. If there are numerous contact areas or the overall contact area is extensive, then the non-dissipated heat causes the powder compact to swell or to be raised from the bottom of the container and, in some cases, parts of the device to melt. Accordingly, in the devices of the present invention, the metallic member is spaced apart from the bottom wall of the container. It also has been observed that if the metallic member emerges at the upper surface of the powder compact, then such surface is divided into areas which are not tightly bound to one another and, consequently, are prone to being ejected within the picture tube during flashing. Accordingly, in the devices of the present invention, the metallic member does not protrude from the upper surface of the powder compact.

The metallic member may be made of metals such as, for example, iron alloys, nickel alloys, and aluminum alloys. The metallic member is preferably made of AISI 304 steel because of its desirable cold workability characteristics.

The metallic member may have a variety of shapes, provided that the member is discontinuous and substantially planar. The metallic member must be discontinuous so that the member does not obstruct the release of barium vapors produced in the underlying getter material powder. The metallic member must be substantially planar so that the member can be embedded in the powder compact, which generally has a thickness of just a few millimeters, without contacting the bottom of the container or emerging from the upper surface of the powder compact.

FIG. 1 shows two embodiments of discontinuous, substantially planar metallic members suitable for use in the frittable evaporable getter devices of the invention. Metallic member 23 has a hub-and-spoke configuration which includes central portion 10 having aperture 12 formed therein and a plurality of projections 14 extending radially from central portion 10. Aperture 12 and the open spaces between projections 14 facilitate the release of barium produced in underlying getter material powder. Metallic member 23' includes generally disk-shaped portion 16 which has a plurality of holes 18 formed therein to facilitate the release of barium produced in the underlying getter material powder. Members 23 and 23' may be formed by any suitable technique, e.g., cutting or punching the desired shape from a metallic blank. Those skilled in the art will recognize that the metallic member may have shapes other than those shown in FIG. 1. For example, the metallic member may be a metallic screen as described in the above-mentioned U.S. Pat. No. 3,558,962, the disclosure of which is hereby incorporated by reference.

FIG. 2 shows a cross-sectional view of a frittable evaporable getter device in accordance with one embodiment of the invention. Device 20 includes container 21 having disk-shaped bottom wall 21*a* and side wall 21*b* extending upwardly from bottom wall 21*a*. Metallic member 23 (or 23') is embedded in powder compact 22 between lower portion 22*a* and upper portion 22*b*. The upper surface 25 of powder compact 22 has a number of radial recesses 26, 26' formed therein, as will be discussed in more detail below.

Device 20 may be formed by pouring a first portion of loose powder into container 21 such that bottom wall 21*a* is covered. Metallic member 23 (or 23') is then placed on the upper surface of the first portion of powder and covered with a second portion of loose powder. Finally, the loose powder is compressed to form powder compact 22 in container 21. The loose powder may be compressed with a shaped punch so that the upper surface 25 of powder compact 22 has radial recesses 26, 26' formed therein. The weight ratio between the first and second portions of loose powder placed in container 21 determines the position of metallic member 23 (or 23') within powder compact 22. Therefore, the weight ratio is selected so that metallic member 23 (or 23') does not emerge from upper surface 25, even where radial recesses 26, 26' are located. In general, satisfactory results are obtained when the ratio between the first portion of powder, which is placed in the container before the metallic member, and the second portion of powder, which covers the metallic member, is between about 1:2 and about 1:3.

Figure 3A:
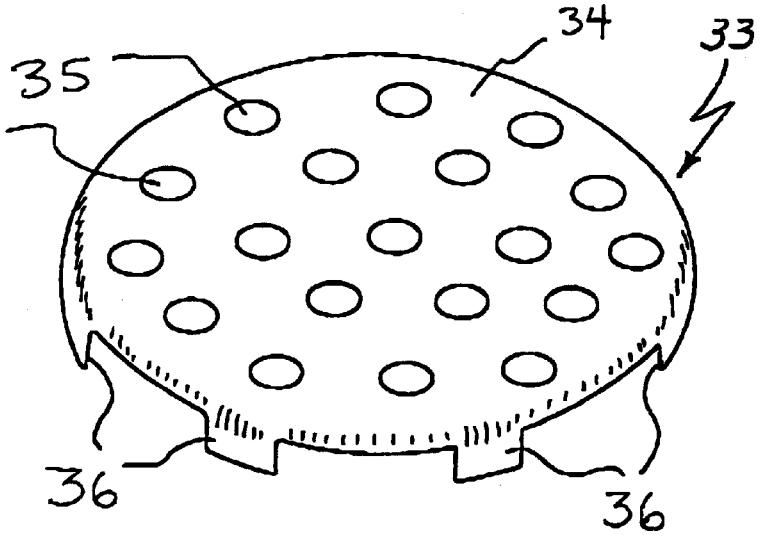
FIG. 3*a* illustrates another embodiment of a metallic member suitable for use in the frittable evaporable getter devices of the invention.

FIG. 3*a* shows another embodiment of a metallic member suitable for use in the frittable evaporable getter devices of the invention. Metallic member 33 includes substantially planar portion 34 which has a plurality of holes 35 formed therein. Planar portion 34 may have any suitable shape but is preferably disk-shaped so that it can nest in a disk-shaped container. A plurality of flange portions 36 extend downwardly from planar portion 34 so as to form "feet" which support portion 34. Those skilled in the art will recognize that the metallic member also may be formed with one continuous flange portion instead of the plurality of flange portions 36 illustrated in FIG. 3*a*.

Figure 3B:
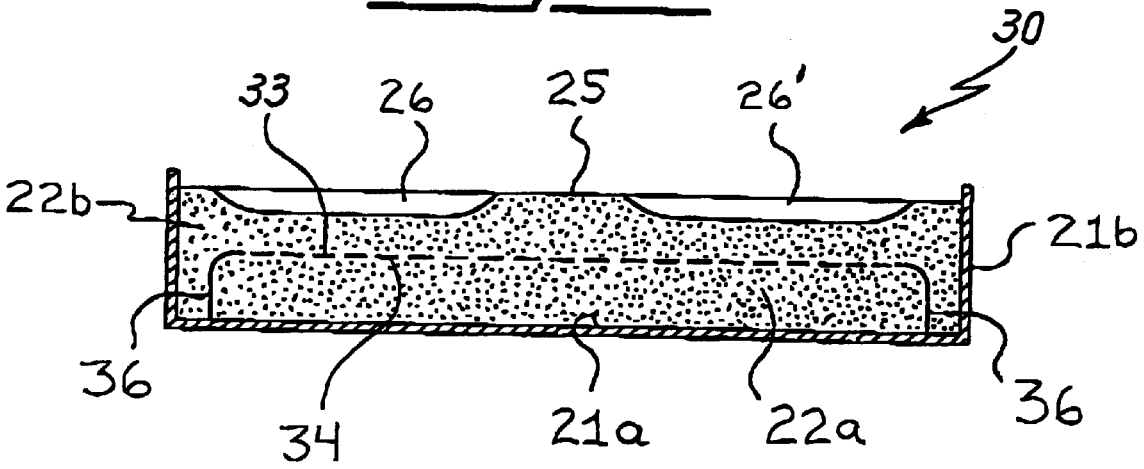
FIG. 3*b* shows a cross-sectional view of a frittable evaporable getter device in accordance with another embodiment of the invention which includes the metallic member shown in FIG. 3*a*.

FIG. 3*b* shows a cross-sectional view of a frittable evaporable getter device in accordance with another embodiment of the invention. Device 30 is the same as device 20 shown in FIG. 2 except that device 30 includes metallic member 33 instead of metallic member 23 or 23'. Metallic member 33 is embedded in powder compact 22 such that flange portions 36 keep planar portion 34 a predetermined distance from bottom wall 21*a* of container 21. Those skilled in the art will recognize that the distance by which flange portions 36 separate planar portion 34 from bottom wall 21*a* is a function of the length of flange portions 36. Barium produced in lower portion 22*a* of powder compact 22 is released through holes 35 (as shown in FIG. 3*a*) in planar portion 34 of metallic member 33. Those skilled in the art will recognize that device 30 may be formed in a manner similar to that described above for device 20 shown in FIG. 2.

Figure 4:
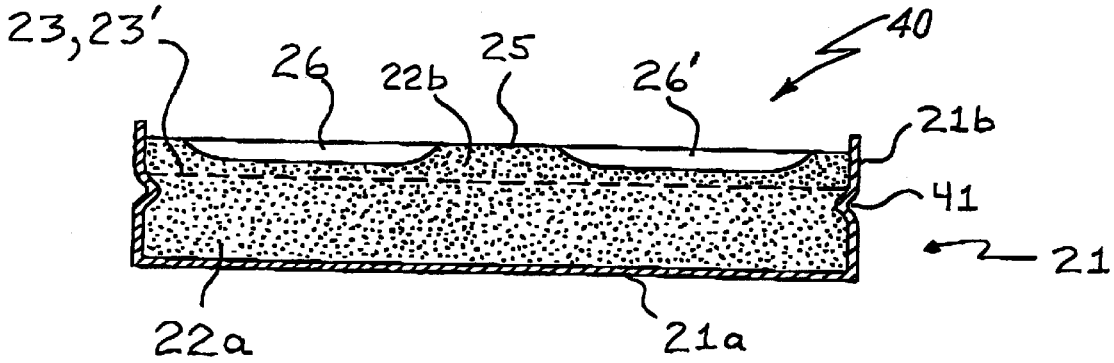
FIG. 4 shows a cross-sectional view of a frittable evaporable getter device which includes an indentation in the side wall of the container in accordance with a further embodiment of the invention.

FIG. 4 shows a cross-sectional view of a frittable evaporable getter device in accordance with a further embodiment of the invention. Device 40 is the same as device 20 shown in FIG. 2 except that side wall 21*b* includes indentation 41 which extends inwardly toward the inner region defined by bottom wall 21*a* and side wall 21*b*. Indentation 41 at least partially supports metallic member 23 (or 23') and keeps member 23 (or 23') from contacting bottom wall 21*a*. As shown in FIG. 4, indentation 41 extends around the entirety of side wall 21*b*. Alternatively, two or more indentations may be formed in side wall 21*b*.

Figure 5:
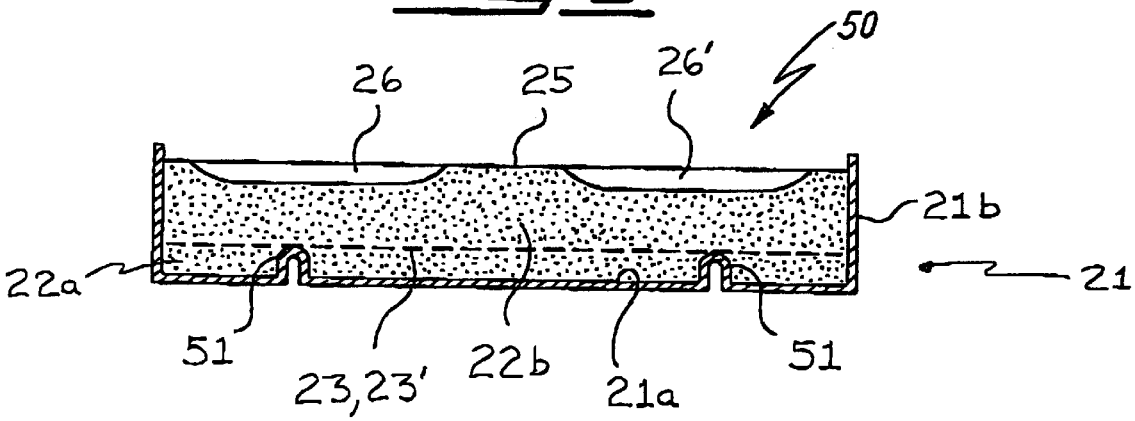
FIG. 5 shows a cross-sectional view of a frittable evaporable getter device which includes an indentation in the bottom wall of the container in accordance with a still further embodiment of the invention.

FIG. 5 shows a cross-sectional view of a frittable evaporable getter device in accordance with a still further embodiment of the invention. Device 50 is the same as device 20 shown in FIG. 2 except that bottom wall 21*a* includes indentation 51 which extends upwardly toward the inner region defined by bottom wall 21*a* and side wall 21*b*. Metallic member 23 (or 23') is placed on indentation 51 so that the area of contact between member 23 (or 23') and bottom wall 21*a* is minimized to avoid local overheating as discussed above. As shown in FIG. 5, indentation 51 defines a continuous, annular channel in bottom wall 21*a*. Alternatively, two or more indentations may be formed in bottom wall 21*a*.

Figure 6:
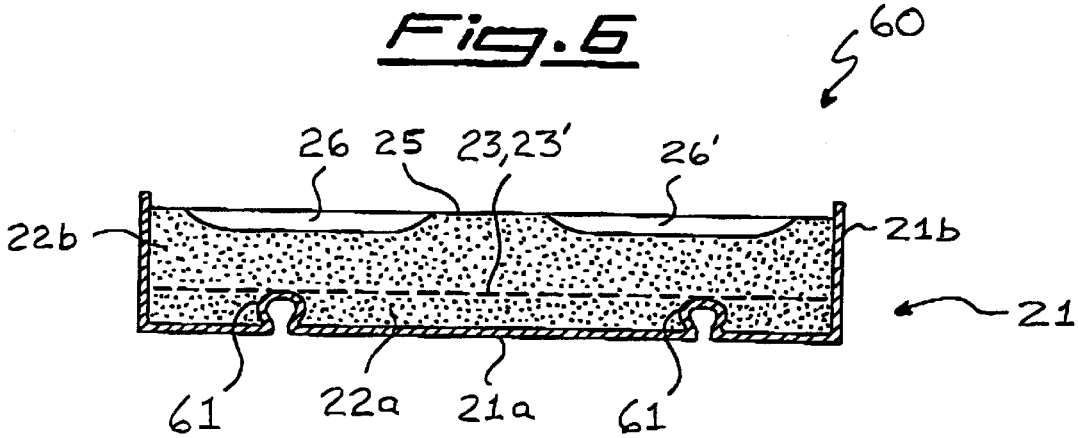
FIG. 6 shows a cross-sectional view of a frittable evaporable getter device which includes an annular groove in the bottom wall of the container in accordance with yet another embodiment of the invention.

FIG. 6 shows a cross-sectional view of a frittable evaporable getter device in accordance with yet another embodiment of the invention. Device 60 corresponds to device 50 shown in FIG. 5 modified to include the mechanical anchoring element described in U.S. Pat. No. 4,642,516 to Ward et al., the disclosure of which is hereby incorporated by reference. Specifically, device 60 includes annular groove 61 formed in bottom wall 21*a* which serves to anchor powder compact 22 in container 21. As can be seen in FIG. 6, groove 61 has a generally bulb-shaped cross-section. Metallic member 23 (or 23') is placed on groove 61 so that the area of contact between member 23 (or 23') and bottom wall 21*a* is minimized to avoid local overheating as discussed above.

Metallic container 21 shown in FIGS. 2, 3*b*, and 4–6 may be any suitable container, e.g., commercially available containers. Such containers are typically made of steel, preferably AISI type 304 or 305, because of the ease with which it can be cold-worked by pressing and its excellent resistance to oxidation during the frit sealing operation. As can be seen in, e.g., FIG. 2, the shape of container 21 corresponds to that of a short cylinder having a closed bottom end and an open top end. Those skilled in the art will recognize that this basic shape may be varied to include, for example, one or more indentations in the bottom wall or the side wall as described above.

The powder compact may be comprised of a mixture of $BaAl_4$ powder and nickel powder. The particle size of the $BaAl_4$ powder is preferably less than about 250 $\mu$m and the particle size of the nickel powder is preferably less than about 60 $\mu$m. The ratio by weight between the $BaAl_4$ powder and the nickel powder is preferably between about 1.2:1 and about 1:1.2, and more preferably about 1:1. As described above, the powder compact may be formed by pouring a mixture of loose powder in the container and pressing the loose powder with a suitable punch. The punch is preferably configured to form a number of radial recesses in the upper surface of the powder compact, as described in the above-mentioned U.S. Pat. No. 5,118,988, the disclosure of which is hereby incorporated by reference. The number of radial recesses formed in the upper surface of the powder compact is preferably from two to eight and these recesses retard heat dispersion in the powder compact in a circumferential direction.

To reduce the activation time of the frittable evaporable getter devices described herein, the powder compact is preferably comprised of a mixture of $BaAl_4$ powder, nickel powder, and between about 0.3% and about 5% by weight based on the total weight of the mixture of a third component selected from the group consisting of aluminum, iron, titanium, and alloys thereof. The preferred amount of the third component in the mixture depends on the material used. In the case of aluminum, the preferred amount is between about 0.8% and about 2% by weight based on the total weight of the mixture. In the case of iron, the preferred amount is between about 0.3% and about 1.2% by weight based on the total weight of the mixture. In the case of titanium, the preferred amount is between about 0.5% and about 5% by weight based on the total weight of the mixture. When the amount of the third component in the mixture is less than the indicated amounts, the desired effect of reducing the barium evaporation time is not obtained. On the other hand, when the amount of the third component in the mixture is greater than the stated amounts, the barium flash rages out of control. The weight ratio between the nickel powder and the $BaAl_4$ powder in the three-component mixture is preferably about 1:1, and more preferably about 5.3:4.7.

Commercially available powders having a purity of about 98% to 99% of the specified materials are suitable for use as the powder of the third component. The particle size of the powder of the third component is preferably less than about 80 $\mu$m, and more preferably less than about 55 $\mu$m.

Figure 7:
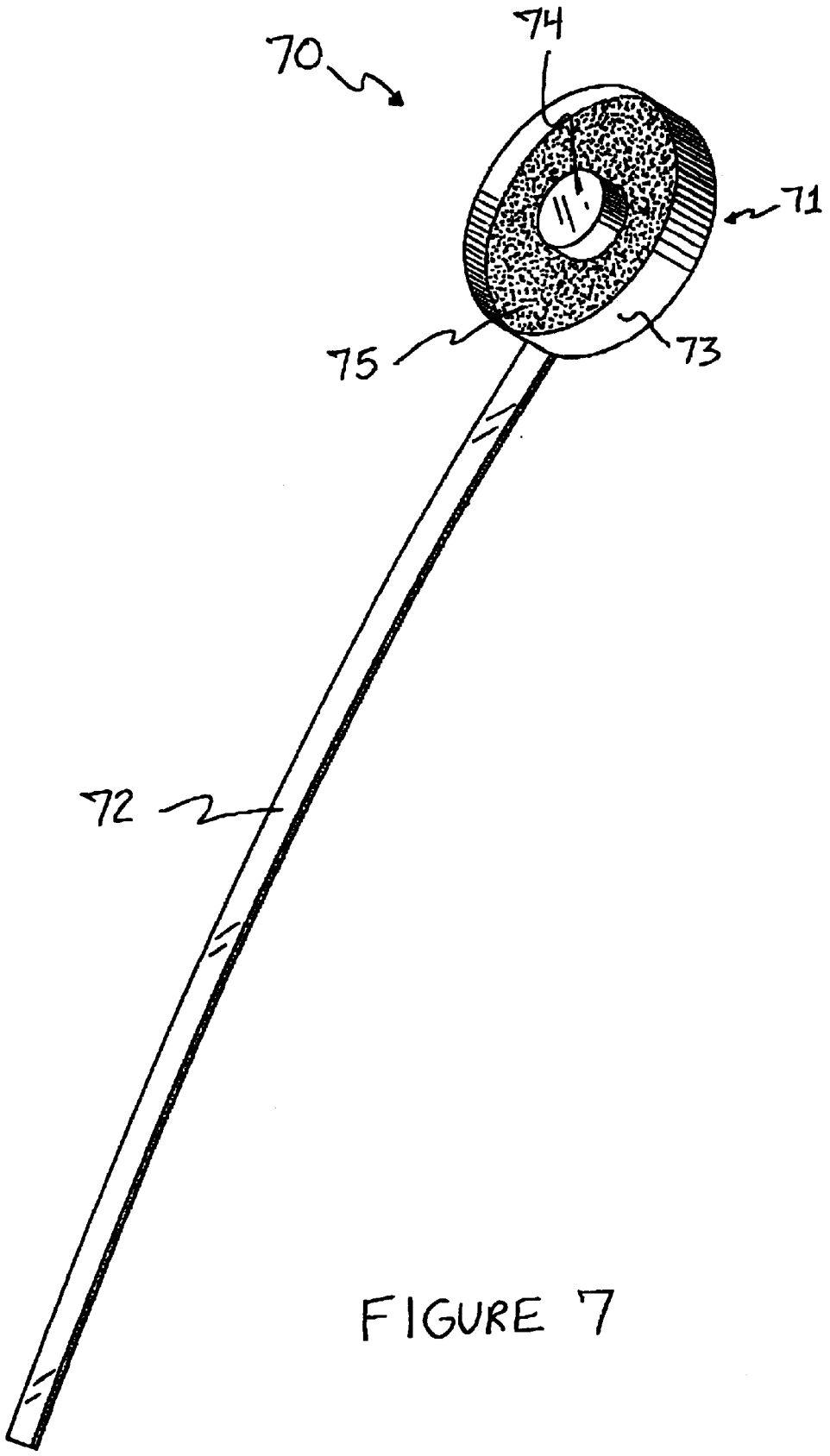
FIG. 7 is a perspective view of a conventional evaporable getter device which includes the evaporable getter material with reduced activation time of the invention.

In addition to the frittable evaporable getter devices described herein, the evaporable getter material having reduced activation time of the invention also may be used in conventional evaporable getter devices such as shown in FIG. 7. Device 70 includes metallic container 71 mounted on antenna support 72 by, e.g., spot welds, as is known in the art. Container 71 includes side wall 73 which extends upwardly from a disk-shaped bottom wall (not visible in FIG. 7) and elevated central portion 74. Powder compact 75 is disposed in the annular region defined by side wall 73 and central portion 74 and is comprised of a mixture of $BaAl_4$ powder, nickel powder, and between about 0.3% and about 5% by weight based on the total weight of the mixture of a third component selected from the group consisting of aluminum, iron, titanium, and alloys thereof as described above.

The frittable evaporable getter devices of the invention also may include a nitrogen dispenser compound. As is known to those skilled in the art, the presence of nitrogen in the picture tube during barium flashing enables more extensive and uniform deposits of barium to be obtained. Accordingly, it may be desirable to include small quantities of nitrogen compounds such as, for example, iron nitride, $Fe_4N$, germanium nitride, $Ge_3N_4$, or intermediate nitrides of iron and germanium in the powder compact.

EXAMPLES

The evaporable getter devices of the invention will now be described in terms of specific examples. It should be borne in mind that the examples given below are merely illustrative of particular applications of the inventive devices and should in no way be construed to limit the usefulness of the invention in other applications.

Example 1

A getter device was prepared using a container of AISI 304 steel having a diameter of 20 mm and a height of 4 mm with the bottom having an indentation 1 mm high (see, e.g., FIG. 5). A metallic screen made of AISI 304 steel and having mesh of 1.5 mm width was placed on the indentation. A homogeneous mixture comprised of 775 mg of $BaAl_4$ powder (for a total content of 403 mg barium) and 875 mg of nickel powder was then poured into the container. Next, the powder mixture was compressed within the container with a punch shaped to form four radial recesses in the surface of the resultant powder compact. The thus-formed device was treated at 450° C. for 1 hour in air to simulate frit sealing conditions. The device was then placed in a glass flask connected to a pump system, the flask was evacuated, and a barium evaporation test was conducted following the method described in standard ASTM F 111-72 while heating the device by means of radio frequencies for 35 seconds with a power selected to initiate the onset of evaporation after 15 seconds of heating. The result of this test is reported in Table 1, which includes notes describing the evaporation details, the condition of the remainder of the device, and the quantity of evaporated barium.

Example 2

The test of Example 1 was repeated using a powder mixture containing a nitrogen dispenser compound. Specifically, the powder mixture included 825 mg of $BaAl_4$ powder, 785mg of nickel powder, and 40 mg of $Fe_4N$. The results of this test are reported in Table 1.

Comparative Example 3

The test of Example 1 was repeated, but without including the metallic screen embedded in the powder compact. The results of this test are reported in Table 1.

Comparative Example 4

The test of Example 1 was repeated, but a flat punch was used to compress the powder mixture so that the upper surface of the powder compact did not include radial recesses. The results of this test are reported in Table 1.

Comparative Example 5

The test of Example 1 was repeated, but using a container with a flat bottom so that the metallic screen rested on the bottom of the container. The results of this test are reported in Table 1.

Comparative Example 6

The test of Example 1 was repeated, but using a device in which the metallic screen emerges from the upper surface of the powder compact. This device was prepared by pouring the powder mixture into the container, laying the metallic screen upon the loose powder, and compressing the screen and the powder mixture simultaneously by means of a flat punch. The results of this test are reported in Table 1.

TABLE 1

| EXAMPLE | NOTES |
|---|---|
| 1 | Intact powder compact; intact container; evaporated barium: 300 mg. |
| 2 | Intact powder compact; intact container; evaporated barium: 330 mg. |
| 3 | Ejection of the powder compact; evaporated barium: non-detectable. |
| 4 | Remarkable central swelling of the powder compact; evaporated barium: 300 mg. |
| 5 | Melting of the container; evaporated barium: non-detectable. |
| 6 | Ejection of fragments from the surface of the powder compact; evaporated barium: non-detectable. |

As can be seen in Table 1, the devices formed in accordance with the invention (Examples 1 and 2) appear to be frittable because they do not exhibit problems such as swelling of the powder compact, ejection of the powder compact, or melting of the container. Furthermore, these devices allow barium yields of 300 mg or more to be obtained. On the other hand, in each of the devices of the comparative examples there is swelling, full or partial ejection of the powder compact, or even melting of the whole device.

Example 7

A number of identical getter devices were prepared using a container of AISI 304 steel having a diameter of 20 mm and a height of 4 mm with the bottom having an indentation 1 mm high (see, e.g., FIG. 5). A homogeneous mixture comprised of 767 mg of $BaAl_4$ powder having a particle size of less than 250 $\mu$m, 866 mg of nickel powder having a particle size less than 60 $\mu$m, and 18 mg of iron powder having a particle size of less than 80 $\mu$m and a purity of 99% was then poured into each container. Next, the powder mixture was compressed within each container with a suitable punch to form a powder compact. Each device was then placed in a glass flask connected to a pump system, each flask was evacuated, and a barium evaporation test was conducted following the method described in standard ASTM F 111-72 while heating each device by means of radio frequencies with a power selected to initiate the onset of evaporation after 12 seconds of heating. The total time (TT) of heating in the tests ranged between 35 seconds and 45 seconds. At the end of each test, the amount of evaporated barium was detected. The TT required to evaporate a barium quantity of 300 mg from each device is reported in Table 2.

Example 8

A number of identical getter devices were prepared using a container as described in Example 7. A metallic screen made of AISI 304 steel and having mesh of 1.5 mm width was placed on the indentation in each container. A homogeneous mixture comprised of 767 mg of $BaAl_4$ powder having a particle size of less than 250 $\mu$m, 866 mg of nickel powder having a particle size less than 60 $\mu$m, and 18 mg of aluminum powder having a particle size of less than 50 $\mu$m and a purity of 99% was then poured into each container. Next, the powder mixture was compressed within each container with a punch shaped to form four radial recesses in the surface of the resultant powder compact. The thus-formed devices were treated at 450° C. for 1 hour in air to simulate frit sealing conditions. A barium evaporation test was conducted on each device as described in Example 7. In each test the device was heated by means of radio frequencies with a power selected to initiate the onset of evaporation after 12 seconds of heating. The total time (TT) of heating in the tests ranged between 35 seconds and 45 seconds. At the end of each test, the amount of evaporated barium was detected. The TT required to evaporate a barium quantity of 300 mg from each device is reported in Table 2.

Comparative Example 9

The tests of Example 7 were repeated, but with devices in which the powder mixture did not contain iron powder. The TT required to evaporate 300 mg of barium from these devices is reported in Table 2.

Comparative Example 10

The tests of Example 8 were repeated, but with devices in which the powder mixture did not contain aluminum powder. The TT required to evaporate 300 mg of barium from these devices is reported in Table 2.

TABLE 2

| EXAMPLE | THIRD COMPONENT (% by weight) | TOTAL TIME (seconds) |
|---|---|---|
| 7 | 1.09 (Fe) | 35 |
| 8 | 1.09 (Al) | 35 |
| 9 | 0 | 45 |
| 10 | 0 | 40 |

As can be seen in Table 2, in the devices formed in accordance with the invention (Examples 7 and 8) barium yields of 300 mg can be obtained with a TT of 35 seconds. In the devices of the comparative examples the TT required to obtain the same yield of barium is 5–10 seconds longer.

While this invention has been described in terms of several preferred embodiments, there are alterations, permutations, and equivalents which fall within the scope of this invention. If should also be noted that there are many ways of implementing the evaporable getter devices of the present invention so that they are frittable or have reduced activation time or both. It is therefore intended that the following claims be interpreted as including all such alterations, permutations, and equivalents as fall within the true spirit and scope of the present invention.

What is claimed is:

1. A frittable evaporable getter device, comprising:

a metallic container having a disk-shaped bottom wall and a side wall extending upwardly from said bottom wall, said bottom wall having at least one indentation which extends upwardly toward an inner region defined by said bottom wall and said side wall;

a powder compact disposed in said container and having an upper surface in which at least two radial recesses are formed, said powder compact being comprised of a mixture of $BaAl_4$ powder and nickel powder; and a discontinuous metallic member embedded in said powder compact such that said member rests on said at least one indentation and said member does not protrude from said upper surface of said powder compact.

2. The device of claim 1, wherein the metallic member is substantially planar.

3. The device of claim 2, wherein the metallic member is substantially parallel to the bottom wall of the container.

4. The device of claim 1, wherein the metallic member includes a central portion having an aperture therein and a plurality of projections extending radially from said central portion.

5. The device of claim 1, wherein the metallic member is disk-shaped and has a plurality of holes formed therein.

6. The device of claim 1, wherein the $BaAl_4$ powder has a particle size of less than about 250 $\mu$m and the nickel powder has a particle size of less than about 60 $\mu$m.

7. The device of claim 1, wherein a weight ratio of $BaAl_4$ powder to nickel powder is between about 1.2:1 and about 1:1.2.

8. The device of claim 1, wherein the weight ratio is about 1:1.

9. The device of claim 1, wherein the powder compact further includes a nitrogen dispenser compound selected from the group consisting of iron nitride, germanium nitride, and intermediate nitrides of iron and germanium.

10. A frittable evaporable getter device, comprising:

a metallic container having a disk-shaped bottom wall and a side wall extending upwardly from said bottom wall, said side wall having an indentation which extends inwardly toward an inner region defined by said bottom wall and said side wall;

a powder compact disposed in said container and having an upper surface in which at least two radial recesses are formed, said powder compact being comprised of a mixture of $BaAl_4$ powder, nickel powder, and between about 0.3% and about 5% by weight based on a total weight of said mixture of a third component selected from the group consisting of aluminum, iron, titanium, and alloys thereof; and a discontinuous metallic member embedded in said powder compact such that said member is at least partially supported by said indentation and said member does not protrude from said upper surface of said powder compact.

11. The device of claim 10, wherein the powder compact contains between about 0.8% and about 2% of aluminum.

12. The device of claim 10, wherein the powder compact contains between about 0.3% and about 1.2% of iron.

13. The device of claim 10, wherein the powder compact contains between about 0.5% and about 5% of titanium.

14. The device of claim 10, wherein said indentation is an annular groove.

15. The device of claim 14, wherein said annular groove has a generally bulb-shaped cross-section.

16. A frittable evaporable getter device, comprising:

a metallic container having a disk-shaped bottom wall and a side wall extending upwardly from said bottom wall, said bottom wall having at least one indentation which extends upwardly toward an inner region defined by said bottom wall and said side wall;

a powder compact disposed in said container and having an upper surface in which at least two radial recesses are formed, said powder compact being comprised of a mixture of $BaAl_4$ powder, nickel powder, and between about 0.3% and about 5% by weight based on a total weight of said mixture of a third component selected from the group consisting of aluminum, iron, titanium, and alloys thereof; and a discontinuous metallic member embedded in said powder compact such that said member rests on said at least one indentation and said member does not protrude from said upper surface of said powder compact.

17. The device of claim 16, wherein the powder compact contains between about 0.8% and about 2% of aluminum.

18. The device of claim 16, wherein the powder compact contains between about 0.3% and about 1.2% of iron.

19. The device of claim 16, wherein the powder compact contains between about 0.5% and about 5% of titanium.

* * * * *